US005113671A

United States Patent [19]

Westermeyer

[11] Patent Number: 5,113,671

[45] Date of Patent: May 19, 1992

[54] OIL SEPARATOR

[75] Inventor: Gary W. Westermeyer, Bluffs, Ill.

[73] Assignee: AC&R Components Components, Inc., Chatham, Ill.

[21] Appl. No.: 617,773

[22] Filed: Nov. 26, 1990

[51] Int. Cl.[5] ..... F25B 43/02; B01D 45/12

[52] U.S. Cl. ..... 62/468; 62/84; 62/470; 55/337; 55/456; 55/457

[58] Field of Search ..... 62/84, 468, 470; 55/456, 457, 337

[56] References Cited

U.S. PATENT DOCUMENTS

| | | | |
|---|---|---|---|
| 2,511,967 | 6/1950 | Campbell . | |
| 2,606,430 | 8/1952 | Pownall . | |
| 2,665,557 | 1/1954 | Dodson . | |
| 3,234,752 | 2/1966 | Quick et al. . | |
| 3,304,697 | 2/1967 | Ramsey . | |
| 3,778,984 | 12/1973 | Lawser . | |
| 4,263,029 | 4/1981 | George . | |
| 4,478,050 | 10/1984 | DiCarlo . | |
| 4,503,685 | 3/1985 | DiCarlo . | |
| 4,506,523 | 3/1985 | DiCarlo . | |
| 4,589,263 | 5/1986 | DiCarlo et al. . | |
| 4,662,190 | 5/1987 | Tischer | 62/84 X |
| 4,690,759 | 9/1987 | Mandy . | |
| 4,717,403 | 1/1988 | Chjoksi . | |
| 4,803,848 | 2/1989 | LaBrecque . | |
| 4,872,316 | 10/1989 | Browne et al. . | |
| 4,880,831 | 10/1989 | Kitamoto . | |

FOREIGN PATENT DOCUMENTS

| | | | |
|---|---|---|---|
| 116134 | 8/1929 | Fed. Rep. of Germany . | |
| 0861895 | 9/1981 | U.S.S.R. . | |
| 6922455 | 4/1982 | U.S.S.R. | 62/470 |

*Primary Examiner*—Henry A. Bennet
*Assistant Examiner*—Christopher B. Kilmer
*Attorney, Agent, or Firm*—Hill, Van Santen, Steadman & Simpson

[57] ABSTRACT

A device for separating oil from a gas is provided which includes a housing forming a peripheral wall with an inlet at a top end of the housing for receiving an oil/gas mixture, a gas outlet formed by a conduit extending through the top end of the housing and an oil outlet at a bottom end of the housing. Within the housing there is a helical wall extending between the gas outlet conduit and the peripheral wall to cause the oil/gas mixture to flow in a largely circumferential path along the peripheral wall. Between the helical wall and the peripheral wall there is provided a mesh screen for collecting and separating the oil from the oil/gas mixture. The collected oil drips from the screen to a baffle with apertures therein which directs the oil therethrough for receipt in an oil collection zone below the baffle. The gas outlet conduit has an opening above the baffle for permitting relatively oil-free gas to exit the oil separator.

18 Claims, 2 Drawing Sheets

OIL SEPARATOR

BACKGROUND OF THE INVENTION

The present invention relates to oil separators and more particularly to an oil separator for use in a refrigeration system to separate oil from an oil/refrigerant gas mixture.

Refrigeration systems utilize a compressor to compress a refrigerant gas, a condenser to cool the compressed gas and to cause the gas to condense to a liquid and an evaporator for absorbing heat from the area to be refrigerated as the liquid refrigerant expands and evaporates. In many such systems, oil is used as a lubricant and to provide a more effective seal in the compressor and, by such use, is mixed with the refrigerant gas in the compressor and is carried along with the refrigerant. Oil, however, is not a refrigerant and therefore it reduces the efficiency of the system if the oil is permitted to remain mixed with the refrigerant gas as it moves to the condenser. Therefore, it is known to provide an oil separator in the line between the compressor and condenser to remove the oil from the refrigerant gas. Generally, refrigerant gas from the compressor contains oil in the form of a fog as it enters the oil separator inlet.

Various arrangements have been provided for separating the oil from the gas. For example, U.S. Pat. No. 3,778,984 discloses an arrangement for introducing the oil and gas mixture tangentially to a separator so as to centrifuge the oil from the gas so that the oil will fall downwardly under the force of gravity into a collecting chamber in the bottom of the separator. U.S. Pat. No. 4,478,050 discloses an oil separator in which fluid is introduced tangentially in a chamber bounded by a screen upon which the oil particles collect. The oil and refrigerant mixture is caused to flow in a vortex providing centrifugal separation of oil particles. Deflector tabs are provided to enhance or regenerate the vortex in the lower portion of the chamber above the oil outlet opening. U.S. Pat. No. 4,263,029 discloses an oil separator in which fluid is introduced tangentially in a passageway formed by a spiral wall having a single revolution. The fluid then passes to a chamber bounded by an annular ring and then to a chamber bounded by a funnel shaped wall with a central opening for passage therethrough of collected oil and including vanes for guiding the oil to the opening. The "oil free" gas leaves the separator through a central, axial passage.

SUMMARY OF THE INVENTION

The present invention provides an improved oil separator which provides an enhanced oil separation capability without increasing the size of the oil separator. The oil/refrigerant mixture is caused to flow in a generally spiral flow path along the peripheral wall of the oil separator chamber so as to increase the effective path length of the oil/refrigerant mixture along the peripheral wall. A screen mesh is provided along the wall to enhance the separation of oil from the mixture and to provide a collection area for the separated oil.

The separated oil drips from the screen to an inverted funnel/baffle which has a plurality of drain holes therethrough at an outer peripheral rim thereof to allow the separated oil to drop into an oil collection chamber. A float valve arrangement is provided in the oil collection chamber which permits periodic dispensing of the oil from the chamber to an oil reservoir.

The refrigerant gas which is largely free of oil passes through a central passage or conduit to proceed to the condenser.

A preferred method for providing the enhanced effective length of the peripheral wall is to put a stationary helical wall or auger in the annular space between the peripheral wall and the center conduit for leading the refrigerant gas from the separator. The oil/refrigerant mixture is introduced to the oil separator at a top end of the device in a generally axial direction and is caused to impinge upon the flights of the helical wall and to follow the helical path as the mixture moves downwardly.

DESCRIPTION OF THE PREFERRED EMBODIMENTS

Figure 1:
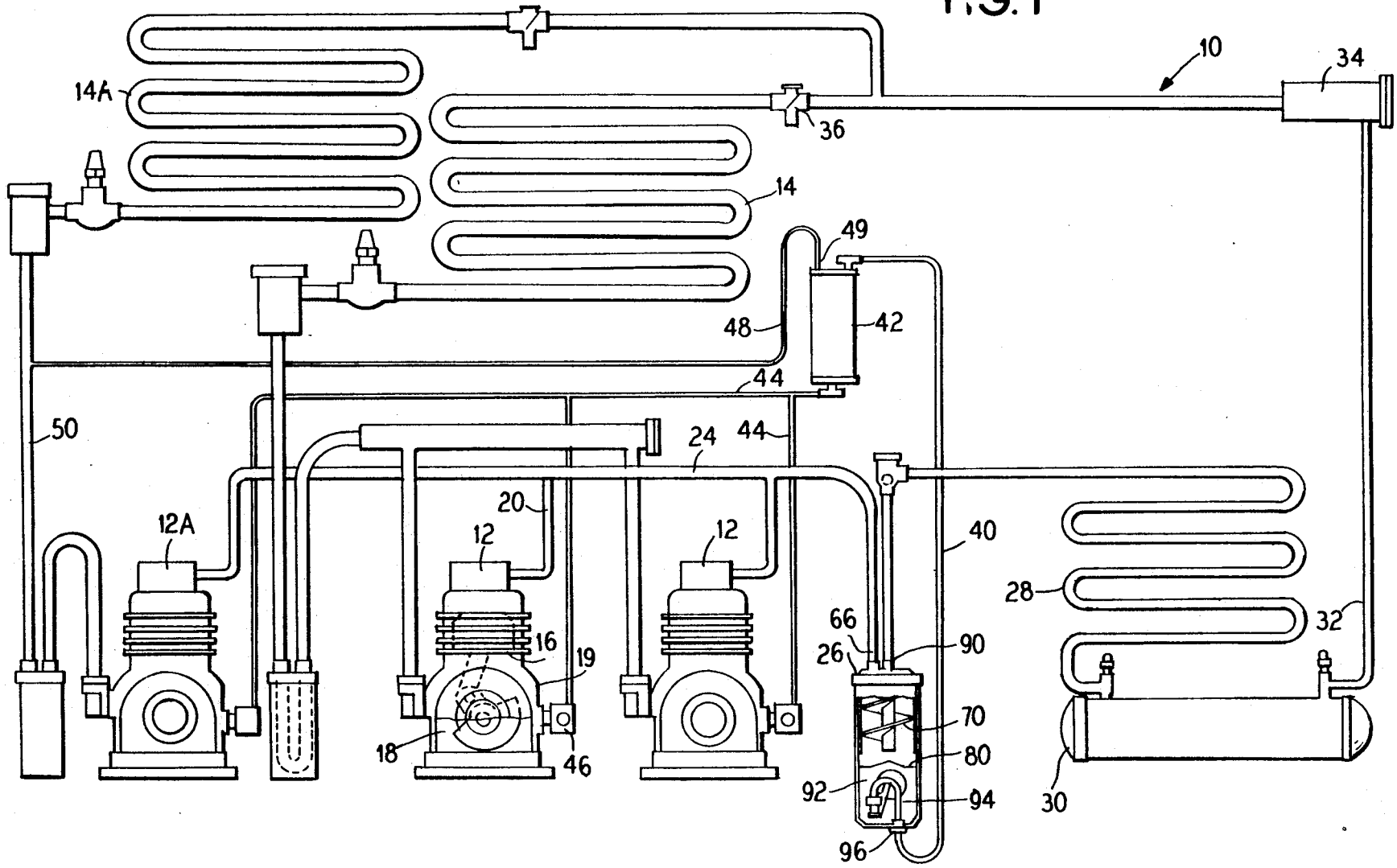
FIG. 1 illustrates a refrigeration system incorporating an oil separator embodying the principles of the present invention.

In FIG. 1 there is illustrated a standard refrigeration system 10. In such a system one or more compressors 12 are used to compress a refrigerant gas after that gas has expanded in an evaporator 14. The compressors 12 utilize a reciprocating piston 16. Oil 18 is provided in an abundant supply within a crankcase 19 of the compressor 12 both to provide lubrication to the piston 16 as well as to enhance the sealing of the piston within the compressor so as to increase the efficiency of the compressor. During operation of the compressor, the oil becomes atomized and mixed with the refrigerant as the mixture leaves through an exit conduit 20. The mixture passes into a manifold 24 which communicates with additional compressors 12 if there are multiple compressors arranged in a parallel arrangement.

Since the oil is not a refrigerant and the presence of oil in the refrigerant decreases the efficiency of the remainder of the refrigeration system, an oil separator 26 is provided in the line between the compressor 12 and a condenser 28 so as to remove the oil from the gas mixture. An improved oil separator embodying the principles of the present invention is described in greater detail below.

As the gas moves into the condenser 28 it is cooled and is caused to condense into a liquid which is captured in a receiver 30. The cooled refrigerant liquid then flows through a conduit 32, through a filter-dryer 34, and through an expansion valve 36 to the evaporator 14. In the evaporator the liquid refrigerant is caused to evaporate thereby absorbing heat energy and thus cooling an area associated with the evaporator. The refrigerant gas then flows through conduit 38 to return to the compressors 12. More than one evaporator 14, 14A may be provided, and if so, one or more satellite compressors 12A are provided to receive and compress the refrigerant gas from the extra evaporators 14A to feed the compressed gas/oil mixture to the manifold 24 for passage through the oil separator 26.

The oil which has been separated in the oil separator 26 is directed through a conduit 40 to an oil reservoir 42 from which it is supplied through conduits 44 to the compressors 12. Oil level regulators 46 associated with each compressor allow for the introduction of the proper amount of oil to the compressors. The oil reservoir 42 is provided with a vent line 48 having a valve 49 therein which reduces the pressure within the oil reservoir to a level just slightly in excess of that present in a gas inlet line 50 so as to provide a slight positive pressure to ensure an adequate oil supply from the oil reservoir 42 to the oil level regulators 46.

The oil level regulators 46 control the oil level in each crankcase 19 by means of a float operated valve. The oil level regulator 46 holds back excess oil until the oil level in the compressor crankcase 19 drops, lowering the float and opening the valve. Oil from the oil reservoir 42 will then be admitted into the crankcase raising the float. When the correct level is reached, the valve will close, stopping the flow of oil to that particular crankcase. The oil level regulators may also be adjustable to provide slightly varying oil levels within the crankcase as disclosed in U.S. Pat. No. 4,428,208, assigned to the assignee of the present invention and incorporated herein by reference.

Figure 2:
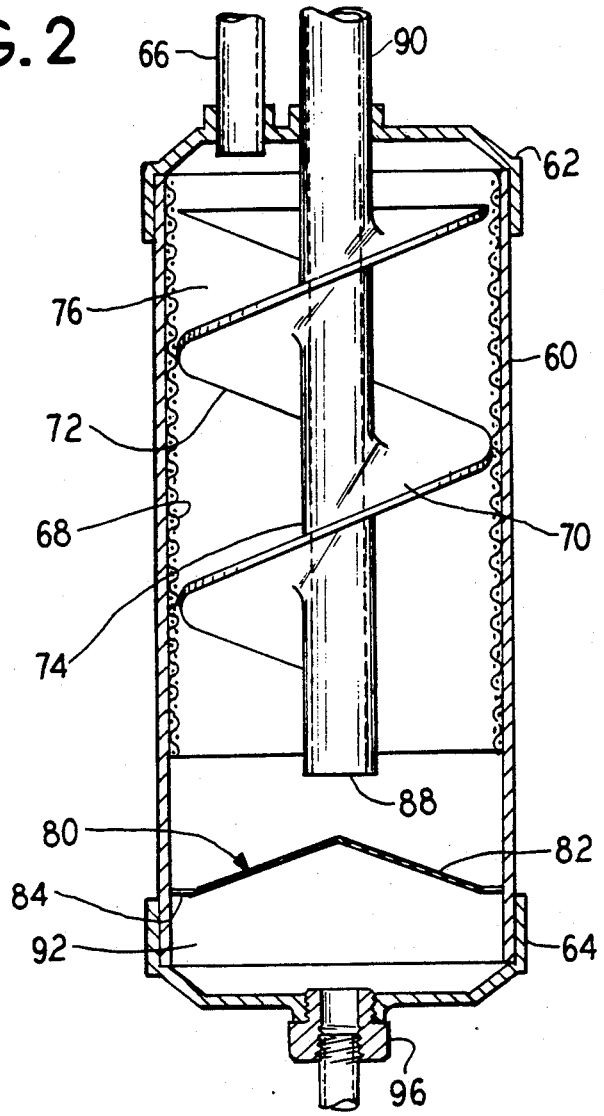
FIG. 2 is a side sectional view of an oil separator embodying the principles of the present invention.
Figure 3:
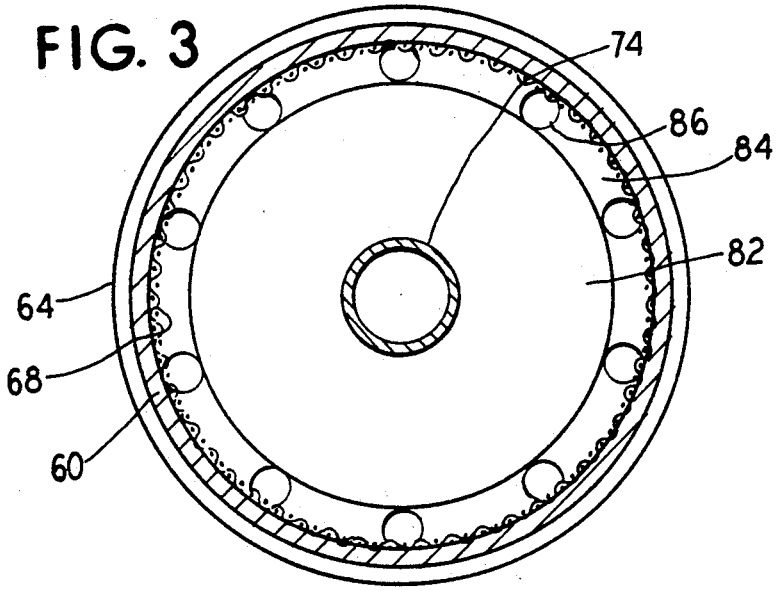
FIG. 3 is a sectional view taken generally along the line III—III of FIG. 2.

The improved oil separator 26 embodying the principles of the present invention is shown in greater details in FIGS. 2 and 3. The oil separator has a generally cylindrical vertical axis outer housing or peripheral wall 60 which is closed by a top end cap 62 and a bottom end cap 64. The top end cap 62 includes an inlet 66 extending parallel to an axis of the housing for connection to the manifold 24 from the compressors 12. The oil enters the oil separator inlet 66 in the form of a fog carried along with the refrigerant gas. Lining an inside surface of the oil separator housing 60 is a means for collecting and separating oil from the oil/gas mixture, preferably in the form of a mesh screen 68 which preferably is a 20 mesh steel wire cloth made with 0.016" wire diameter. The screen 68 extends around the entire periphery of the housing 60 and extends along a portion of the height of the housing from the top end cap 62 towards the bottom.

Interior of the housing is a static auger 70 which has a helical thread wall or flights 72 formed thereon and extending outwardly from a central hollow cylindrical conduit 74 toward the peripheral wall 60. The wall 72 of the auger 70 is sized to be closely adjacent to or in contact with the steel mesh liner, but spaced from the peripheral wall 60, such that a helical flow path 76 results between the inlet 66 and a lower portion of the collector. The helical wall 72 preferably makes at least two full revolutions. Thus, the oil/refrigerant mixture will be forced to follow a largely circumferential flow path along the mesh screen 68 providing a substantially longer effective length of the steel mesh screen seen by the oil/refrigerant mixture than if the oil/refrigerant mixture were allowed to flow axially along the peripheral wall 60. Of course, a largely circumferential flow path, other than a helical flow path can be provided by appropriately arranged walls between said peripheral wall 60 and said conduit 70.

Both the mesh screen 68 and the auger 70 terminate well above the bottom end cap 64. Spaced below the mesh screen 68 and the auger 70 is an inverted funnel/-baffle 80 which has a central conical wall 82 sloping downwardly and outwardly to a relatively horizontal peripheral rim area 84 which continuously engages the peripheral wall 60. In the peripheral rim area 84 are provided a plurality of apertures 86 which act as drain holes for the oil which has collected on the mesh screen 68 and which has dripped from the screen. The refrigerant, which is now relatively free of oil, exits the oil separator 26 through the interior of the conduit 74 through a bottom opening 88 thereof which is spaced above the baffle 80 and leaves the oil separator 26 at an outlet 90 which leads to the condenser 28.

The oil which has separated from the refrigerant and which has drained through the apertures 86 collects in a collection area or chamber 92 in the bottom of the oil separator. Preferably a float valve 94 is provided as shown in FIG. 1 to periodically dispense collected oil from the collection zone through an oil return fitting 96 to the conduit 40 leading to the oil reservoir 42.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A device for separating oil from a gas comprising:
- a cylindrical vertical axis housing forming a peripheral wall of said device;
- a top end cap;
- a bottom end cap;
- an inlet parallel to said axis of said cylindrical housing extending through said top end cap;
- a gas outlet formed by a cylindrical wall forming a central passage aligned with said axis;
- a helical wall formed within said cylindrical housing between said peripheral wall and said cylindrical wall;
- a conical baffle having a downwardly and outwardly sloping wall spaced below said helical wall;
- a plurality of apertures extending through an outer rim area of said baffle adjacent to said peripheral wall;
- an oil collection zone below said baffle; and
- an oil outlet in said oil collection zone extending through said bottom end cap controlled by a valve.

2. A device according to claim 1, wherein said helical wall terminates radially inward of said peripheral wall to form a space therebetween.

3. A device according to claim 2, including means for collecting and separating oil from said oil/gas mixture located in said space between said helical wall and said peripheral wall.

4. A device according to claim 3, wherein said means for collecting and separating oil comprises a mesh screen liner on the interior of said peripheral wall.

5. A device according to claim 1, wherein said helical wall extends through more than one full revolution.

6. A device according to claim 5, wherein said helical wall extends through at least two revolutions.

7. A device according to claim 1, wherein said baffle is spaced below a bottom end of said cylindrical wall.

8. A device according to claim 1, wherein said baffle extends across a diameter of said housing and is in continuous engagement with said peripheral wall.

9. A device for separating oil from a gas comprising:
- a cylindrical vertical axis housing formed by a peripheral wall and having closed top and bottom ends;
- an oil/gas mixture inlet extending parallel to said axis of said cylindrical housing through said closed top end;

a gas formed by a cylindrical wall extending through said top end and having a lower end interior of said housing, said cylindrical wall forming a central passage coaxial with said axis;

a helical wall extending more than a full revolution about said axis, extending from said cylindrical wall towards, but terminating radially inwardly of, said peripheral wall, and extending only a portion of an axial length of said housing from an area adjacent said top end towards said bottom end;

a conical baffle having a downwardly and outwardly sloping wall spaced below said helical wall and below said lower end of said cylindrical wall, said baffle extending across a diameter of said housing and being in continuous engagement with said peripheral wall;

at least one aperture extending through an outer rim area of said baffle adjacent to said peripheral wall;

an oil collection zone below said baffle; and an oil outlet in said oil collection zone extending through said bottom end controlled by a valve.

10. A device according to claim 9, including means for collecting and separating oil from said oil/gas mixture located between said wall means and said peripheral wall.

11. A device according to claim 9, wherein said means for collecting and separating oil comprises a mesh screen liner on the interior of said peripheral wall.

12. A device according to claim 9, wherein said helical wall extends through at least two revolutions.

13. A device for separating oil from a gas comprising:

a vertical axis housing formed by a peripheral wall and having closed top and bottom ends;

an oil/gas mixture inlet provided adjacent to said closed top end;

a gas outlet conduit formed by a cylindrical wall extending through said top end and having a lower end interior of said housing said cylindrical wall forming a central passage coaxial with said axis;

a helical wall extending more than a full revolution about said axis, extending from said conduit wall towards, but terminating radially inwardly of said peripheral wall, and extending from an area adjacent said top end and terminating above said bottom end;

baffle means having a downwardly and outwardly sloping wall spaced below said helical wall and below said lower end of said cylindrical wall;

at least one aperture extending through an outer rim area of said baffle adjacent to said peripheral wall;

an oil collection zone below said baffle; and an oil outlet in said oil collection zone controlled by a valve.

14. A device according to claim 13, including means for collecting and separating oil from said oil/gas mixture located between said wall means and said peripheral wall.

15. A device according to claim 14, wherein said means for collecting and separating oil comprises a mesh screen liner on the interior of said peripheral wall.

16. A device according to claim 13. wherein said wall means comprises a helical wall.

17. A device according to claim 16, wherein said helical wall extends through at least two revolutions.

18. A device according to claim 13, wherein said housing comprises a vertical axis cylinder.

* * * * *

UNITED STATES PATENT AND TRADEMARK OFFICE

CERTIFICATE OF CORRECTION

PATENT NO. : 5,113,671

DATED : May 19, 1992

INVENTOR(S) : Gary W. Westermeyer

It is certified that error appears in the above—identified patent and that said Letters Patent is hereby corrected as shown below:

In column 5, line 1, after "gas" insert --outlet--.

Signed and Sealed this

Seventh Day of September, 1993

Bruce Lehman

*Attest:*

BRUCE LEHMAN

*Attesting Officer*

*Commissioner of Patents and Trademarks*